US006053620A

United States Patent [19]

Won

[11] Patent Number: 6,053,620

[45] Date of Patent: Apr. 25, 2000

[54] WATER-DRAINING PASSAGE STRUCTURE OF A LAMP SET FOR ORNAMENT

[76] Inventor: Jen-Chen Won, P.O. Box 96-405, Taipei 106, Taiwan

[21] Appl. No.: 09/344,324

[22] Filed: Jun. 24, 1999

[51] Int. Cl.[7] ..... F21V 33/00

[52] U.S. Cl. ..... 362/96; 362/226; 362/249

[58] Field of Search ..... 362/96, 806, 294, 362/226, 249; 439/190

[56] References Cited

U.S. PATENT DOCUMENTS

| | | | |
|---|---|---|---|
| 5,443,399 | 8/1995 | Wang | 439/619 |
| 5,605,395 | 2/1997 | Peng | 362/226 |
| 5,707,138 | 1/1998 | Pan | 362/226 |
| 5,709,457 | 1/1998 | Hara | 362/96 |
| 5,722,771 | 3/1998 | Wang | 362/249 |

*Primary Examiner*—Stephen Husar
*Assistant Examiner*—Hargobind S. Sawhney

[57] ABSTRACT

An improvement of water-draining passage structure of a lamp set for ornament, in which a bulb base has a bulb hole for receiving a bulb; the outer part thereof has a cylinder body with two parallel vertical flats, and the center between the two vertical flats has an elongate channel with a rectangular hole extended through a water-proof rim and to the outer edge of the bulb hole; between the elongate channel and an upper groove of the rectangular block, there is a groove extended to the bottom of the bulb hole; the socket has a guide groove, of which the wider flat surface is furnished with a longitudinal groove; the longitudinal groove has an oblique wall surface nearing the rectangular groove of the bulb base; by means of the wall surface extended to the bottom thereof and the groove on the shoulder part of the bulb base, a continuous passage is formed for draining off water.

1 Claim, 5 Drawing Sheets

WATER-DRAINING PASSAGE STRUCTURE OF A LAMP SET FOR ORNAMENT

BACKGROUND OF THE INVENTION

1. Field of the Invention

This invention relates to a decorative lamp, and particularly to a decorative lamp set with a water-draining passage structure.

2. Description of the Prior Art

In the conventional decorative lamp string for Christmas season, the lamp sets are connected in series one another by means of two or more than two power-supply wires; every socket of a lamp set has a guide groove for receiving two copper terminals on two power-supply wires to plug into two copper-terminal grooves in a rectangular groove. The open end of the socket has a hollow cylinder for receiving a bulb base mounted with a bulb. Two copper wires of the bulb will be laid through a bulb hole of the bulb base, and then the tail ends of the two copper wires are bent to attach on two wall surfaces on both sides thereof respectively. After the bulb base is plugged in the socket, the two copper wires of the bulb will be in contact with the two copper terminals respectively; a plurality of lamp sets will be connected in series by means of power-supply wires to form into a lamp string.

The aforesaid lamp string can be hanged on a tree or other suitable place; the lamp string will swing with the wind. The plugging end of the power-supply wires of every lamp set is an open end. The open guide groove between the two power-supply wires is subject to having rainwater entered along the two power-supply wires and through the guide groove end of the socket. If the socket is in a still condition, the rain water would not flow into the guide groove because of the surface tension effect of water drops. In case of the socket being swung with the wind, the water drops on the guide-groove end would flow into the inner wall surface of the guide groove; if such water drops are not drained away, they would flow into a space between the two copper terminals on the power-supply wires to cause an electric shock to a person who touches the socket; therefore; a water-proof test has been listed in the UL standards, i.e., the UL organization will have a wet lamp set to swing with the wind, and will test whether such a lamp string can pass a water-draining test or not.

In a conventional decorative lamp string, please reference U.S. Pat. No. 5,605,395, both sides of the lamp base are furnished with two longitudinal separation channels respectively; after the lamp base is plugged into the hollow cylinder and the rectangular groove of the socket, the inner surface of the longitudinal separation channels on the hollow cylinder will locate above the wall surface of the bulb, while the outer surface thereof will be in contact with the wall surface of the hollow cylinder of the lamp base. The wider wall surface of the rectangular groove of the socket is furnished with a longitudinal groove, which is connected with the aforesaid longitudinal separation channel to form into a through longitudinal passage in the socket. Whenever rain water enter the guide groove for plugging power-supply wires, the rain water can be drained away through the longitudinal passage in the socket and along the inner surface of the guide groove of the socket. In fact, the longitudinal grooves of the aforesaid patent are furnished on the wide surfaces on both sides of the rectangular groove for plugging the two copper terminals of the two power-supply wires; the guide groove between the two power-supply wires is not isolated; when rain water enters the guide groove along the power-supply wires, the rain water will stay and accumulate between the two copper terminals. As a result of the surface tension effect of water drops, the water drops will be unable to drain away upon the lamp set swinging with the wind because of the passage being two narrow; consequently, electric shock might take place.

According to skill as disclosed in the aforesaid patent, symmetrical longitudinal separation channels furnished on the cylinder surface of the lamp base have long been disclosed in U.S. Pat. No. 5,443,399; the cylinder surface of the bulb base of the aforesaid patent is furnished with symmetrical longitudinal separation channels. After the bulb base is mounted with a bulb, and the bulb base is plugged into the hollow cylinder and the rectangular groove, the separated cylinder will clamp the bulb in place without rotation; otherwise the two copper wires pulled out will be twisted to cause a short-circuit.

SUMMARY OF THE INVENTION

The prime object of the present invention is to provide a lamp set structure, in which the bulb base has a bulb hole for plugging a bulb therein; the outer part thereof is a cylinder body furnished with two parallel vertical flats, of which the center is furnished with an elongate channel having a rectangular hole extended through the water-proof rim, and to the outer edge of the bulb hole; a mid-groove is furnished between the elongate channel in the center of the vertical flat and the upper groove on the rectangular block; the wide flat surface of the guide groove has a longitudinal groove, and the inner end of the longitudinal groove has an oblique wall surface nearing the rectangular groove; by means of the oblique wall surface and a groove on the shoulder part, the grooves on both ends thereof are connected together to form into a continuous water-draining passage so as to have water drops in the socket drained off quickly upon swinging with the wind.

Another object of the present invention is to provide a lamp set structure, in which both sides of the cylinder body are furnished with two symmetrical vertical flats, and a mid-groove is furnished between the two vertical flats; one end of the mid-groove is connected with the rectangular hole of the water-proof rim, while other end thereof is connected with the upper groove between two flat surfaces of the rectangular block so as to form into a continuous groove; there is a space between the groove and the wall surface of the inner side of the socket so as to have a wider sectional area to facilitate rain water in the socket to drain off quickly upon swinging with the wind.

Still another object of the present invention is to provide a lamp set structure, in which a sectional area of the passage is formed by means of the upper groove on the rectangular block and the longitudinal grooves on both sides of the guide groove; the vertical flats on both sides of the cylinder body and the inner cylinder surface of the socket are formed into a sectional area of passage; the oblique inner wall surface on both sides of the rectangular groove and the bulb base are formed into a sectional area of passage; the rectangular hole on both sides of the center bulb hole of bulb base also has a sectional area; each of the aforesaid sectional areas is over one (1) square millimeter; a smooth-connection edge is furnished between every two connected grooves so as to facilitate water drops in the socket to be drained off quickly upon swinging with the wind.

DETAILED DESCRIPTION OF THE PREFERRED EMBODIMENT

Figure 1:
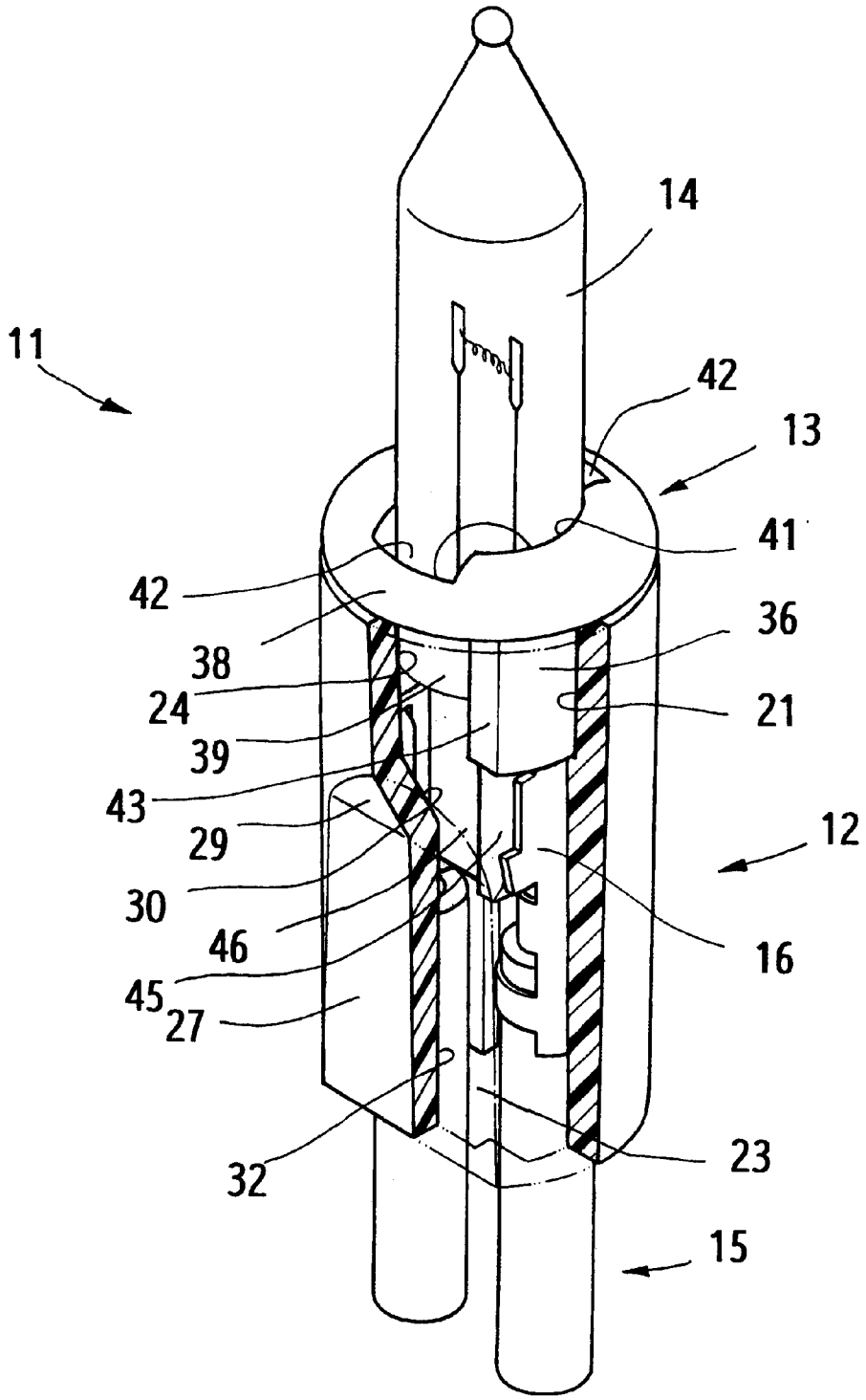
FIG. 1 is a fragmental section view of the present invention.
Figure 2:
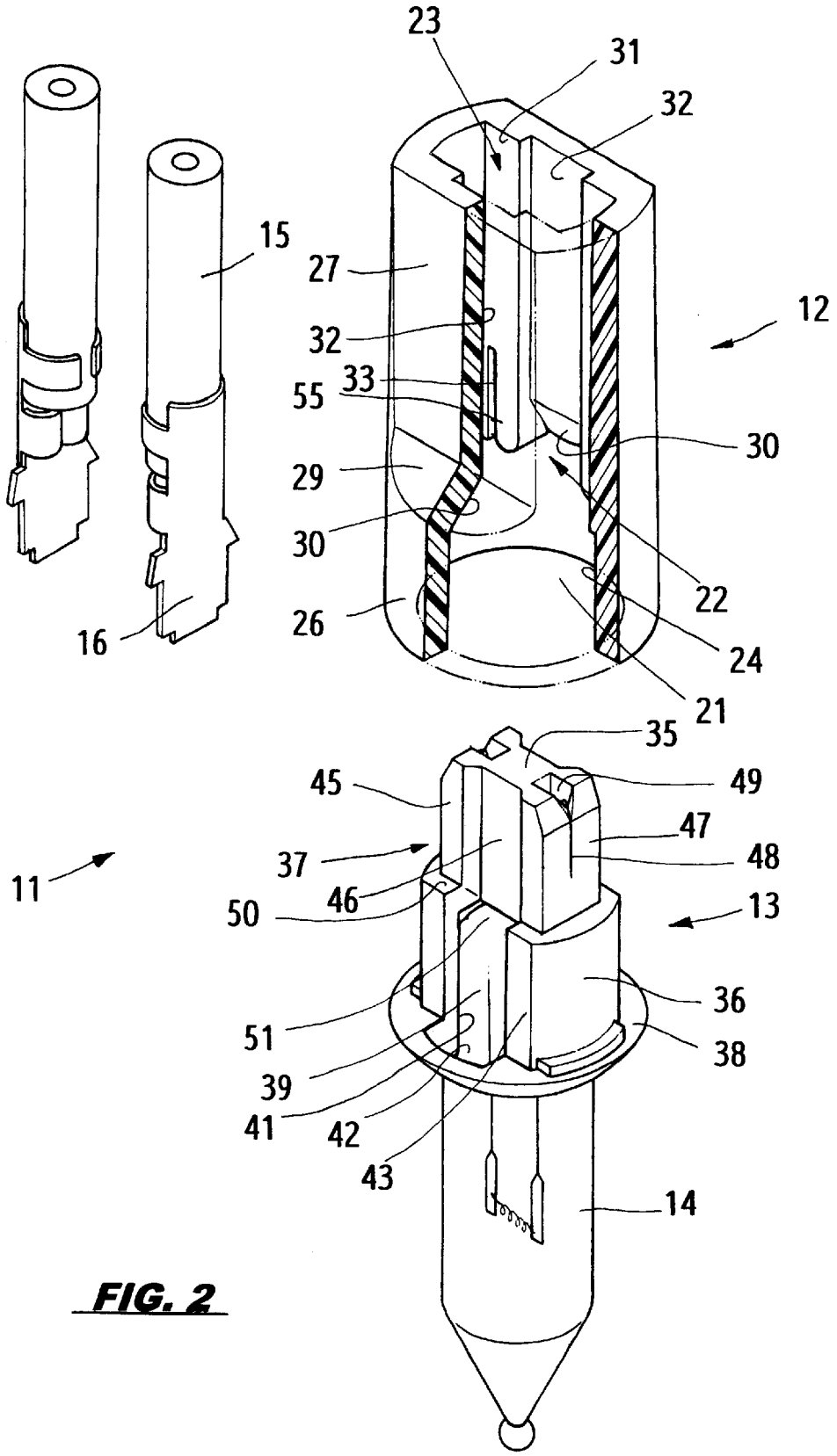
FIG. 2 is a disassembled view of the present invention, showing the relation among parts thereof.
Figure 3:
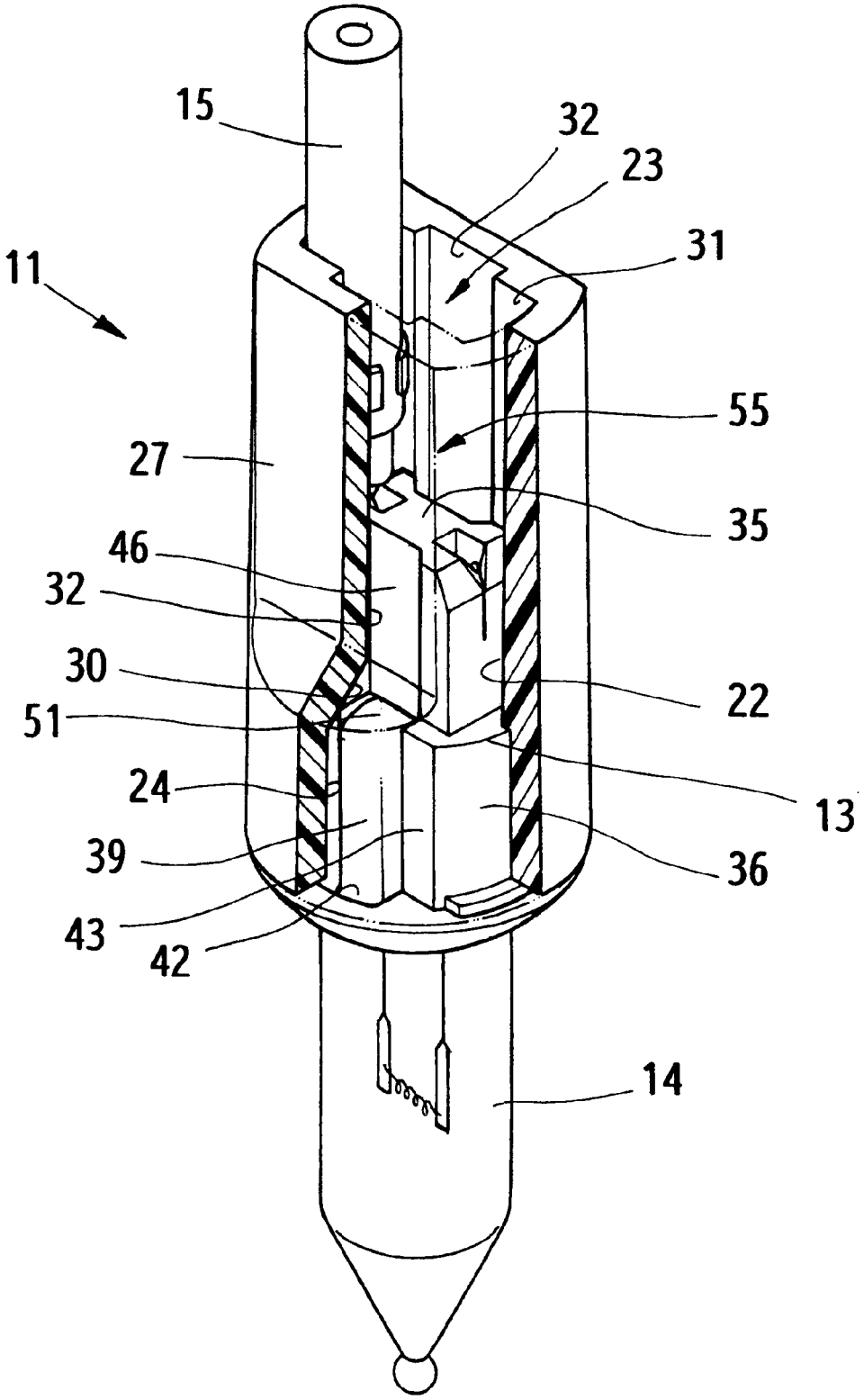
FIG. 3 is a fragmental sectional view of the present invention, showing the water-draining passage structure of the socket.
Figure 4:
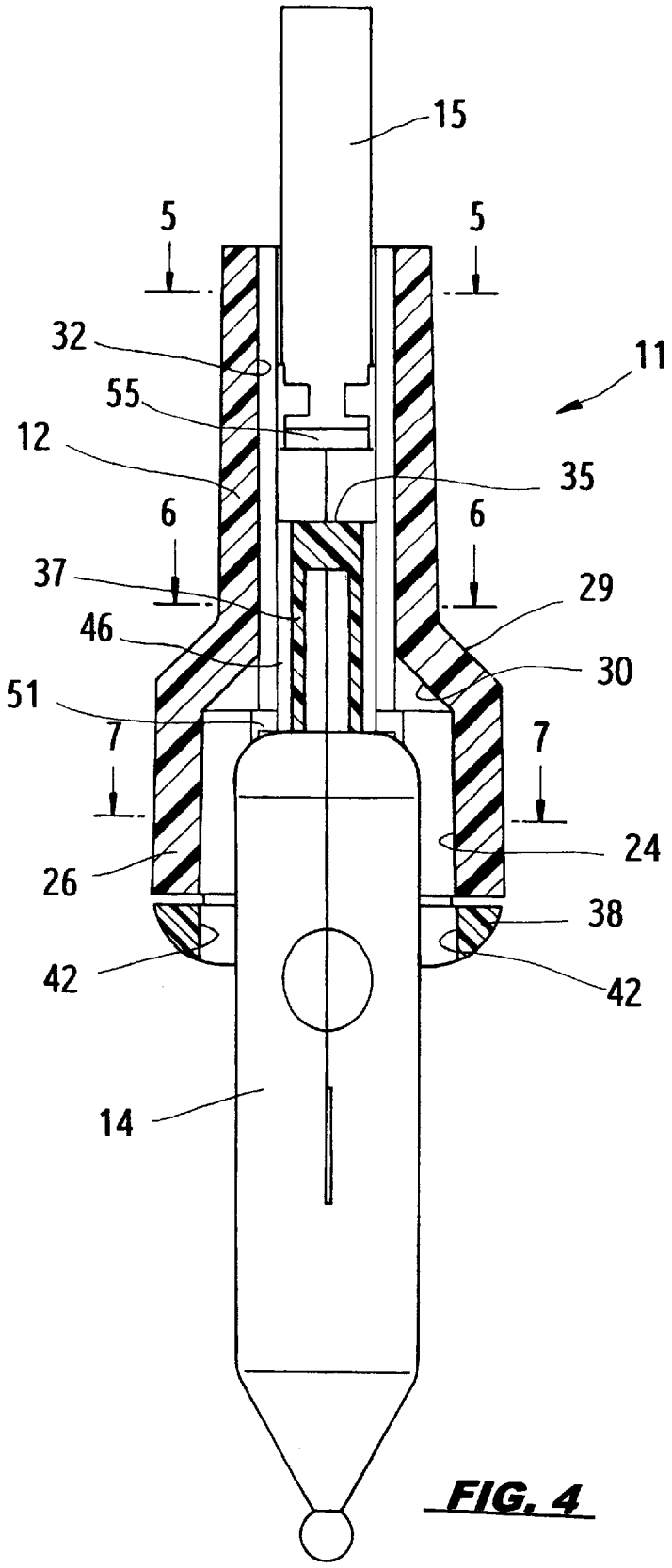
FIG. 4 is a sectional view of the present invention, showing the water-draining passage structure of the socket.
Figure 5:
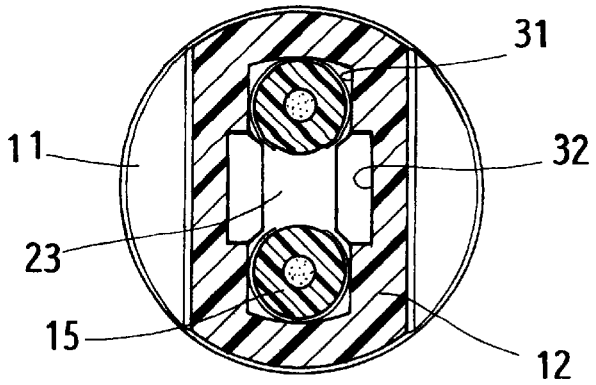
FIG. 5 is a sectional view of the present invention taken along line 5—5 of FIG. 4.
Figure 6:
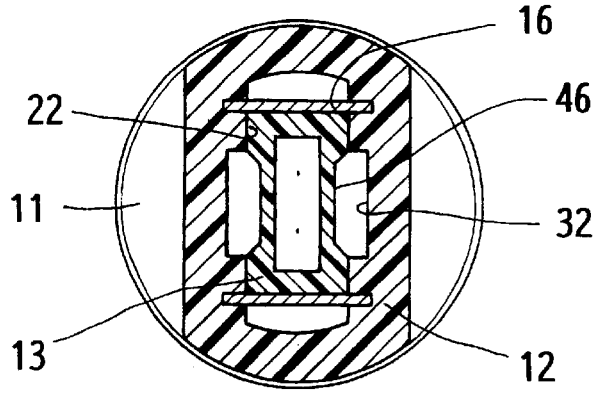
FIG. 6 is a sectional view of the present invention taken along line 6—6 of FIG. 4.
Figure 7:
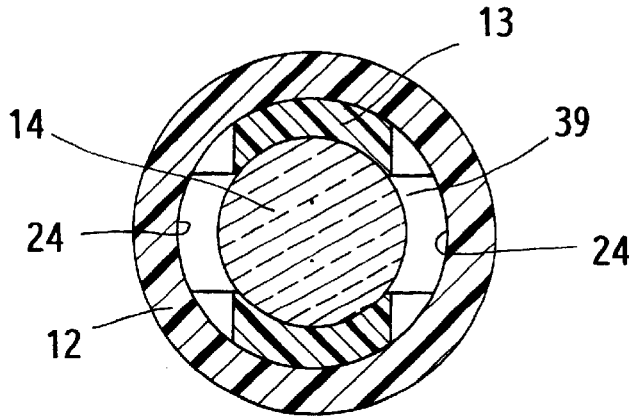
FIG. 7 is a sectional view of the present invention taken along line 7—7 of FIG. 4.

Referring to FIGS. 1 to 3, a water-draining passage structure of a lamp set is provided; each lamp set 11 of the decorative lamp string according to the present invention includes a socket 12, a bulb base 13, a bulb 14, a pair of power-supply wires 15 and two copper terminals 16; the tail ends of the power-supply wires 15 are connected with two copper terminals 16 respectively. One end of the socket 12 is furnished with a guide groove 23 for laying the power-supply wires 15 and the copper terminals 16, while the other end thereof is furnished with a hollow cylinder 21 to mount a bulb base 13 and a rectangular groove 22; both sides of the rectangular groove 22 are provided with two copper-terminal grooves 33 respectively for plugging the copper terminals 16 connected with power-supply wires 15; the two copper terminals 16 are plugged into the guide groove 23 and extended into the two copper-terminal groove 33 respectively on both sides of the rectangular groove 22. A cylinder body 36 has a bulb base 13 on a rectangular block 37; the upper end of the cylinder body has a bulb hole 41 for receiving a bulb 14. The bulb 14 has two copper wires 48 extended through a groove port 49 of the bulb base 13, and bent outwards respectively to attach on two wall surfaces 47. After the bulb base 13 is plugged into the socket 12, the two copper wires 48 of the bulb 14 will be in contact with the two copper terminals on both sides of the rectangular groove 22 respectively so as to have the bulb 14 connected with power supply.

Referring to FIGS. 1 to 5, the guide groove 23 in the bottom portion of the socket 12 is used to facilitate the two power-supply wires 15 to pass through; the copper terminals 16 on the ends of the power-supply wires 15 are to be plugged into the copper-terminal grooves 33 on both sides of the rectangular groove 22 respectively. The upper part of the guide groove 23 is furnished with a rectangular groove 22 and a hollow cylinder 21; both sides of the rectangular groove 22 are furnished with two copper-terminal grooves 33 respectively for receiving two copper terminals 16 on tail ends of the power-supply wires 15 respectively. The rectangular groove 22 mounted with copper terminals 16 in the socket 12 is used for plugging a rectangular block 37 on the lower end of the bulb base 13. The two copper terminals on both sides of the rectangular groove 22 are isolated from each other without touching. The cylinder body 36 of the bulb base 13 is to be plugged into the inner cylinder surface 24 of the socket 12.

The guide groove 23 in the socket 12 is used to have two power-supply wires 15 passed through, and there is a considerable space left in the groove 23; as a result, rain water is subject to enter the guide groove 23 along the power-supply wires 15; in that case, the rain water would accumulate on the end part 35 under the rectangular block 37 of the bulb base 13, i.e., in a hollow space 55 between the two copper terminals 16 of the two power-supply wires 15. The point is that whether such water in the hollow space 55 can be drained or not.

In order to facilitate water in the hollow space 55 to be drained off, the center of the wall surfaces 31 on both sides of the guide groove 23 are furnished with two symmetrical longitudinal grooves 32 respectively as shown in FIG. 2. The longitudinal grooves 32 extend up to the upper end of the rectangular groove 22 respectively; then, they are formed into oblique wall surfaces 30 to extend to the inner cylinder surface 24 under the rectangular groove 22 respectively. The outside of the oblique wall surface 30 has a flat surface 27 and an outer cylinder surface 26, between which there is an adjoining surface 29; the inner cylinder surface 24 under the oblique wall surface 30 has a thickness almost the same as the part of the longitudinal groove 32; in other words, the toughness of the socket 12 would not be affected.

Referring to FIGS. 2 to 7, the outside of the bulb base 13 includes a cylinder body 36 and a rectangular block 37, and the inside thereof has a bulb hole 41 for plugging a bulb 14. The rectangular block 37 is to be plugged into the rectangular groove 22. The wider flat surfaces 45 on both sides of the rectangular block 37 are furnished with two upper grooves 46 respectively. One end of the upper groove 46, which nears the end part 35, is subject to retain water. The cylinder body 36 of the bulb base 13 is to be plugged into the inner cylinder surface 24 of the socket 12. The outer surface of the cylinder body 36 is in close contact with the inner cylinder surface 24 of the socket 12. The lower part of the cylinder body 37 is furnished with a vertical flat 43, of which the center has an elongate channel 39 being in communication with the bulb hole 41. After the bulb base 13 is mounted in the socket 12, the surface of the cylinder body 36 will be in close contact with the inner cylinder surface 24 of the socket 12; a space will also be formed between the vertical flat 43 and the inner cylinder surface 24 of the socket 12. Between the elongate channel 39 and the shoulder part 50 under the rectangular block 37, there is a mid-groove 51 to have the upper groove 46 and the bulb hole 41 connected together. The upper groove 46 between the two flat surfaces 45 of the rectangular block 37, the mid-groove 51 through the shoulder part 50, and the elongate channel 39 between the two symmetrical vertical flats 43 are connected and formed into a continuous passage, of which the sectional area is over one (1) square millimeter.

The lower part of the cylinder body 36 of the socket 12 has a water-proof rim 38. The elongate channel 39 between the two symmetrical vertical flats 43 has a rectangular hole 42 to extend through the water-proof rim 38; the inner edge of the rectangular hole 42 is the inner surface of the bulb hole 41; the outer edge of the rectangular hole 42 is in registration to the inner cylinder surface 24 of the socket 12 so as to form into a through hole.

After the bulb base 13 is plugged into the hollow cylinder 21 of the socket 12, the rectangular hole 42 on the water-proof rim 38 of the bulb base 13 is kept in open condition, and is in communication with the guide groove 23 under the socket 12; water flowed therein from the bulb hole 41 of the water-proof rim 38, or from the guide groove 23 under the socket 12 will be drained off via the through passage upon swinging with the wind because of the through passage providing air convection.

The lamp string hung outdoors will swing with the wind. When the bulb 14 faces downwards in the rain, the rain water will flow along the two power-supply wires 15 into the longitudinal grooves 32 on both sides of the guide groove 23, and the water will flow to the end part 35 of the bulb base 13; since the upper groove 46 has a suitable width, the adhesive force of the water drops will be destroyed; then, the water will flow into the upper grooves 46 on both sides; the upper grooves 46 and the extended continuous passage thereof have a sectional area over one (1) square millimeter, and the passage would not be affected by the surface tension of the water drops; in other wards, the water therein will flow down through the continuous passage upon swinging with the wind, and will be drained off quickly. When the bulb 14 faces upwards in the rain, the water drops will flow into the rectangular hole 42 of the water-proof rim 38 along the bulb 14; in that case, there will be no much water to enter as a result of the limit of the sectional area of the rectangular hole 42; when such water enters the hollow space 55 of the end part 35 of the bulb base 13, the water drops will be in contact with the power-supply wires 15, and will flow out along the through passage having a larger sectional area between the two power-supply wires.

In the present invention, two symmetrical rectangular holes 42 are furnished between the bulb hole 41 and the water-proof rim 38; a space is formed between the elongate channel 39 of the symmetrical vertical flats 43 and the inner cylinder surface 24. The mid-groove 51 formed with the cylinder body 36 and the shoulder part 50 nearing the rectangular block 37, and the oblique wall surface 30 of the socket 12 are then formed into a space, which is connected with the upper groove 46 to provide a through passage. When water drops enter, the water drops will be drained off quickly via the through passage upon swinging with the wind as a result of air convection and the sectional area over one (1) millimeter thereof; then, the socket 12 would not cause any danger because of water therein being able to drain off quickly.

What is claimed is:

1. An improvement of water-draining passage structure of a lamp set for ornament comprising a socket, a bulb base, two power-supply wires and two copper terminals; a bulb to be plugged in a bulb hole of said bulb base; two copper wires of said bulb passed through groove ports in said bulb base respectively and bent and attached to two wall surfaces respectively on both sides of said bulb base; said two copper terminals attached to tail ends of said two power-supply wires to be plugged into a guide groove and through a space in said socket, and finally plugged into two copper-terminal grooves respectively on both sides of a rectangular groove; a cylinder body and a rectangular block of said bulb base to be plugged into a hollow cylinder of said socket; said copper wires and said copper terminals being in contact with each other respectively in said rectangular groove; connecting inner surface between said socket and said bulb base furnished with symmetrical water-draining grooves, and features thereof being described as follows:

two wider flat surfaces in said guide groove for plugging said power-supply wires furnished with two longitudinal grooves respectively; said longitudinal grooves extended from entrance of said power-supply wires to both sides of said rectangular groove for receiving said rectangular block of said bulb base; said longitudinal grooves having an oblique wall surfaces respectively to extend to outer edge of bottom of an inner cylinder surface; both flat surfaces of said rectangular block furnished with two upper grooves respectively; outer edge of each said upper groove being connected with each said longitudinal groove; said cylinder body of said bulb base being plugged into said inner cylinder surface of said socket; flat parts of said cylinder body corresponding to that of said rectangular block being furnished with parallel vertical flats, and center of said vertical flats having an elongate channel extended into said bulb hole; outer edge of said elongate channel being in contact with said inner cylinder surface of said socket; a shoulder part between said vertical flat and said upper groove having an extension groove which being extended through and to bottom of said bulb hole, and outer edge thereof being located in inner space of said oblique wall surface; a rectangular hole furnished between said elongate channel in center of said vertical flat and a water-proof rim; by means of said upper groove between said two flat surfaces, said extension groove of said shoulder part, and said groove between said two symmetrical vertical flats and inner wall surface of said socket, a continuous passage having a sectional area over one (1) square millimeter furnished so as to facilitate water drops inside said socket to drain off quickly upon swinging with the wind.

* * * * *